US005113535A

United States Patent [19]

Hedges et al.

[11] Patent Number: 5,113,535

[45] Date of Patent: May 19, 1992

[54] SIMPLIFIED DUAL VISOR OPERATING MECHANISM

[75] Inventors: George D. Hedges, Lake Ariel; Francis J. Kuna, Carbondale, both of Pa.

[73] Assignee: Gentex Corporation, Carbondale, Pa.

[21] Appl. No.: 740,864

[22] Filed: Jul. 31, 1991

Related U.S. Application Data

[63] Continuation of Ser. No. 588,686, Sep. 26, 1990, abandoned.

[51] Int. Cl.[5] ..... A42B 1/08

[52] U.S. Cl. ..... 2/424; 2/425

[58] Field of Search ..... 2/6, 410, 422, 424, 2/425

[56] References Cited

U.S. PATENT DOCUMENTS

| | | | |
|---|---|---|---|
| 3,636,565 | 1/1972 | Luisada | 2/6 |
| 3,945,043 | 3/1976 | DeAngelis | 2/424 |
| 4,170,792 | 10/1979 | Higgs | 2/6 |
| 4,292,688 | 10/1981 | Ellis | 2/6 |
| 4,305,160 | 12/1981 | Sundahl | 2/424 |
| 4,571,747 | 2/1986 | Briggs | 2/6 |
| 4,621,377 | 11/1986 | Pennell | 2/6 |
| 4,718,127 | 1/1988 | Rittmann et al. | 2/424 |
| 4,907,300 | 3/1990 | Dampney et al. | 2/424 |

FOREIGN PATENT DOCUMENTS

| | | | |
|---|---|---|---|
| 2022989 | 12/1979 | United Kingdom | 2/410 |
| 1560723 | 2/1980 | United Kingdom | 2/424 |
| 2087222 | 5/1982 | United Kingdom | 2/425 |
| 2103467 | 2/1983 | United Kingdom | 2/410 |

*Primary Examiner*—Werner H. Schroeder
*Assistant Examiner*—Michael A. Neas
*Attorney, Agent, or Firm*—Shenier & O'Connor

[57] ABSTRACT

A dual visor and helmet assembly in which inner and outer visors mounted on arbors secured to opposite sides of the helmet for movement between operative and inoperative positions are clamped respectively to one and to the other of the arbors by pre-loaded C-rings coupled to the visors. Respective manually actuatable operating rings on the visors may be actuated to release the clamping forces of the C-rings and to move the visors between their operative and inoperative positions.

23 Claims, 2 Drawing Sheets

SIMPLIFIED DUAL VISOR OPERATING MECHANISM

This is a continuation of copending application Ser. No. 07/588,686 filed on Sep. 26, 1990, now abandoned.

BACKGROUND OF THE INVENTION

There are known in the prior art protective helmets and the like which are provided with inner and outer visors which can selectively be moved from an inoperative position to a position in front of the wearer's eyes. Generally, one of the two visors is clear while the other is tinted. Various mechanisms are known for mounting the visors for movement between operative and inoperative positions and for actuating the visors between the two positions. Most of these mechanisms involve the use of tracks mounted on the helmet body, together with individual operating mechanisms for moving the inner and outer visors. Most of the mechanisms also are provided with means for adjusting the visor to intermediate positions in steps.

Luisada et al Pat. No. 3,636,565 shows another form of dual visor assembly in which opposite arms of the respective visors have noncircular openings receiving respective noncircular shafts on opposite sides of the helmet shell. The other visor arms have circular openings receiving the noncircular shafts. Respective positive locking means associated with the shafts are adapted to be released by pushbuttons to permit the shafts to be turned by knobs.

While mechanisms of the type described above are generally satisfactory, they are relatively complicated and bulky. Owing to their complexity, the mechanisms also are relatively expensive to manufacture.

SUMMARY OF THE INVENTION

One object of our invention is to provide a dual visor operating mechanism which is simpler than are dual visor operating mechanisms of the prior art.

Another object of our invention is to provide a dual visor operating mechanism which is compact.

A still further object of our invention is to provide a dual visor operating mechanism which is less expensive to construct than are dual visor operating mechanisms of the prior art.

Yet another object of our invention is to provide a dual visor operating mechanism which affords infinite adjustment of the individual visors and requires no further action on the part of the user to lock either visor in its position.

Still another object of our invention is to provide a dual visor operating mechanism which affords an adjustable, pre-settable down-stop for either visor.

Other and further objects of our invention will appear from the following description.

BRIEF DESCRIPTION OF THE DRAWINGS

In the accompanying drawings to which reference is made in the instant specification and which are to be read in conjunction therewith and in which like reference characters are used to indicate like parts in the various views.

DESCRIPTION OF THE PREFERRED EMBODIMENT

Figure 1:
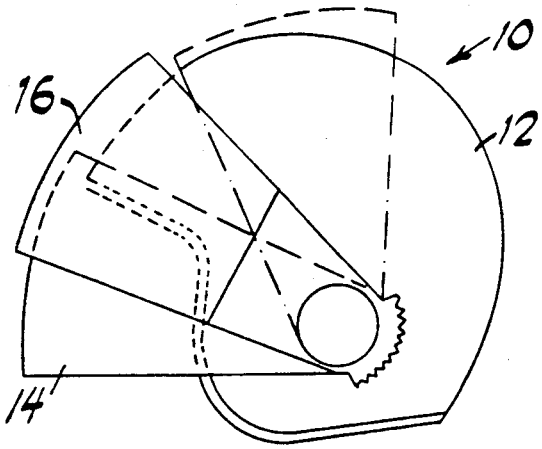
FIG. 1 is a side elevation of a helmet provided with our dual visor operating mechanism.
Figure 2:
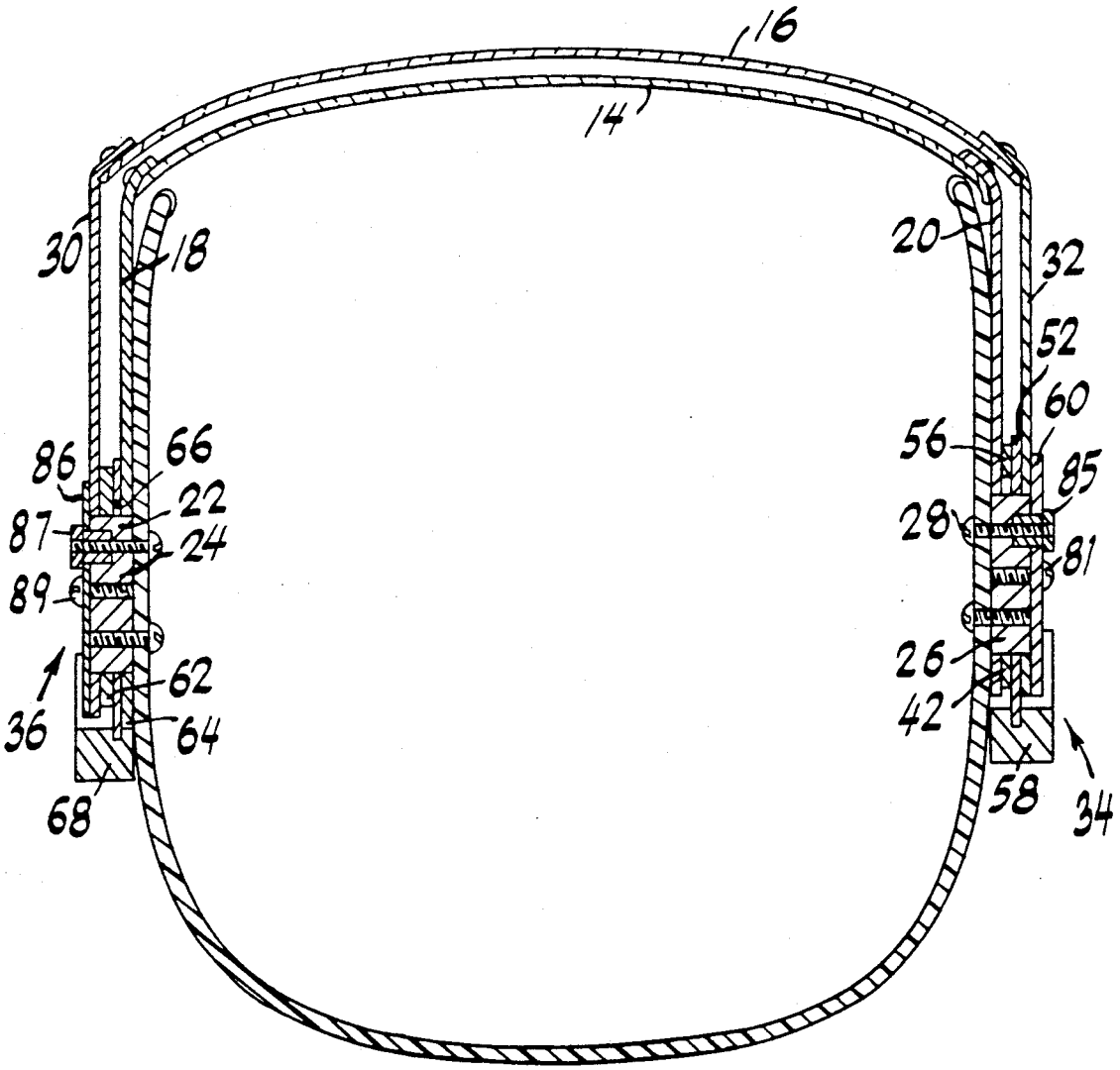
FIG. 2 is a horizontal section of the helmet shown in FIG. 1 looking up into the helmet.

Referring now to FIGS. 1 and 2 of the drawings, a protective helmet indicated generally by the reference character 10 which may be provided with our dual visor operating mechanism includes a hard shell 12 carrying respective inner and outer visors 14 and 16 adapted to be moved between inoperative positions and operative positions in front of the wearer's eyes in a manner to be described hereinbelow.

The inner visor 14 is carried by a pair of inner visor arms 18 and 20 mounted on respective left side and right side arbors 22 and 26 secured to the sides of the shell by any suitable means such as pairs of screws 24 and 28 which prevent rotation of the arbors. As will be apparent from the description hereinbelow, the arm 18 is freely rotatable about the arbor 22 so that this arm may be termed a "coasting" arm. Further as will be apparent from the description hereinbelow, the arm 20 normally is clamped to the arbor 26 and is adapted to be released therefrom when the visor is moved so that it can be termed an "actuating" arm.

The outer visor 16 is carried by respective outer visor arms 30 and 32 supported on the arbors 22 and 26. As will be apparent from the description hereinbelow, outer visor arm 30 is an "actuating" arm while the outer visor arm 32 is a "coasting" arm.

We provide respective inner and outer visor actuating assemblies indicated generally by the respective reference characters 34 and 36. Since the actuating mechanisms 34 and 36 are substantially identical, only one of the two will be described in detail.

Figure 3:
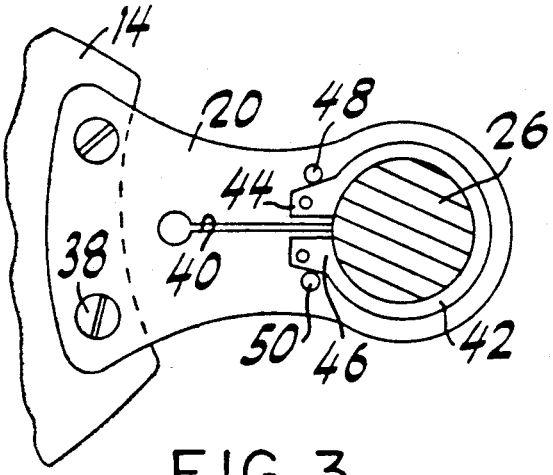
FIG. 3 is a section with parts removed of the operating mechanism of one of the visors in the form of our invention shown in FIG. 1.
Figure 4:
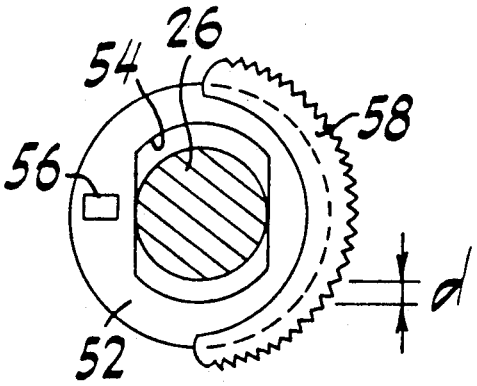
FIG. 4 is a section with parts removed of the visor operating mechanism of one of the visors mounted on the helmet illustrated in FIG. 1.

Referring now to FIGS. 3 and 4, the inner visor actuating arm 20 is secured to the visor 14 by any suitable means such as screws 38. We form arm 20 with a longitudinally extending slot 40 to create springiness in the flat plane of the arm.

A C-ring 42 surrounding the arbor 26 has legs 44 and 46. When the C-ring 42 is assembled on the arbor 26 its legs 44 and 46 are disposed between pre-loading pins 48 and 50 on the arm 20 on opposite sides of the slot 40 so that the ring 42 is tightly clamped to the arbor 26. The length of the slot 40 controls the spring rate of the arm and thus, in conjunction with the location of the pins 48 and 50, the level of clamping force of the pre-loading pins upon the C-ring legs. It will readily be appreciated that any attempt to rotate the arm 20 relative to the arbor 26 will be resisted by the force with which the C-ring 42 engages the arbor. Thus, the visor 14 is clamped to the arbor 26.

Referring now to FIG. 4, arbor 26 also carries an actuating ring 52 provided with an elongated slot 54. The arrangement is such that the shorter dimension of the slot 54 is approximately equal to the diameter of the arbor 26.

Figure 6:
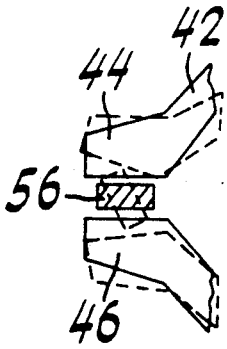
FIG. 6 is a fragmentary view illustrating the mode of operation of our dual visor operating mechanism.

We provide the ring 52 with an actuating element 56 which is disposed in the space between legs 44 and 46 of C-ring ring 42 when the actuating ring is positioned on the arbor 26. The element 56 which is of non-circular cross-section is such that when the ring 52 shifts sideways relative to the arbor 26, it rotates about element 56 and thus causes element 56 to spread the legs 44 and 46 to release the clamping force of ring 42 on the arbor 26 to permit the arm 20 and the visor 14 to be moved. This action is illustrated in FIG. 6.

We provide ring 52 with a knurled knob 58 to facilitate turning of the ring 52 to release the clamping action of ring 42. It will readily be appreciated that the limit of movement of the ring 52 relative to the arbor 26 is equal to the distance d in FIG. 4.

Figure 5:
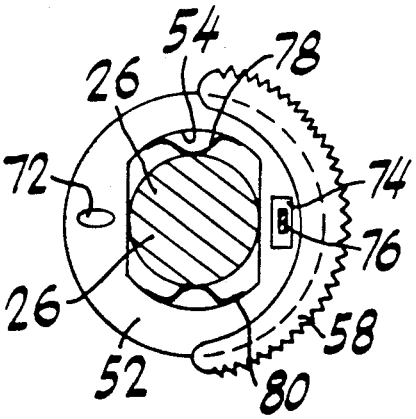
FIG. 5 is a section of a modified form of a part of the operating mechanism illustrated in FIG. 4.

The actuating element 56 may be any suitable shape which will accomplish the purpose of spreading the legs 44 and 46 upon rotation of the ring 52 relative to the arbor. For example, as shown in FIG. 5, it may be an oval actuating element 72.

It will further be appreciated that in some instances it might not be desirable to have ring 52 contact the arbor 26 at the limit of its movement. In order to avoid such an operation, the ring 52 may be formed with an elongated slot 74, as shown in FIG. 5. This slot 74 receives a tang 76 or pin on the visor arm to limit the movement of the actuating ring 52 relative to the arbor 26. It will of course be understood that sufficient clearance is provided between the hole 74 and the tang 76 that the C-ring 42 releases its grip by the time the limit position of the actuating ring is reached.

Preferably we provide the assembly with means for centering the actuating ring 52. For example, compression springs 78 and 80 may be inserted within the opening 54 between the arbor 26 and the ring 52. With this arrangement, the actuating ring is tightly held in position.

Figure 7:
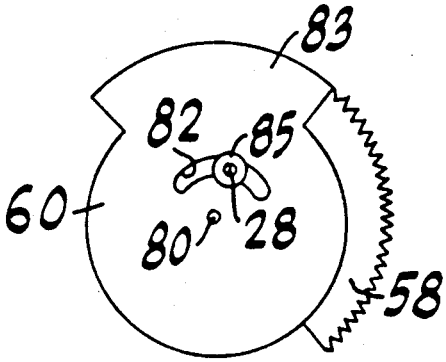
FIG. 7 is a fragmentary view illustrating an adjustment provided by our dual visor operating mechanism.

Referring now to FIGS. 2 and 7, we provide the visor actuating assembly 34 with a down-stop adjustment plate 60 attached to the arbor 26 by means of a screw 81. We form plate 60 with an arcuate slot 82 carrying a fastener 85 adapted to receive one of the mounting screws 28 releasably to secure the fastener 85 in an adjusted position along the length of slot 82. We provide plate 60 with a tang 82 adapted to be engaged by the knob 58.

To make an adjustment, screws 81 and 84 are partially unscrewed to permit down-stop plate 60 to rotate. Plate 60 is then pushed rearward or clockwise as viewed in FIG. 7 to engage knob 58 with tang 82. The helmet is then donned and the wearer, by rotating the actuator knob 58 counterclockwise rotates the visor 20 and down-stop plate 60 into the desired lowest operative position. then, screw 81 is tightened and the visor is rotated back to the inoperative position. The helmet is doffed and screw 28 is tightened, securing the down-stop adjustment plate 60 in the desired position, providing the wearer with a repeatable lowest operative position for the visor.

We provide the visor operating assembly 36 with a down-stop arrangement similar to that provided for assembly 34. A down-stop adjustment plate 86 similar to plate 60 and secured to arbor 24 by a screw 89 has a slot which carries a fastener 87 which receives a mounting screw 24. The operation of this adjustment is the same as that associated with assembly 34.

Referring again to FIG. 2, the outer visor operating mechanism 36 includes an outer visor C-ring 62 associated with another pair of pre-loading pins (not shown), an actuating ring 64 having an elongated opening 66 surrounding the arbor 22 and a knob 68. Ring 64 carries an actuator 70 disposed between the legs of the C-ring 62. The operation of the outer visor mechanism is the same as that described hereinabove in connection with the inner visor operating mechanism.

In operation of our dual visor operating mechanism, the inoperative position of the visors 14 and 16 is indicated by the dot-dash line in FIG. 1. With both visors in this position, should the wearer desire to lower the inner visor 14, he actuates knob 58 in a counterclockwise direction to cause the actuator 56 to spread the legs 44 and 46 of the ring 42 through a distance sufficient to release the ring clamping force. By continuing pressure on the knob, the visor 14 can be lowered. Release of he knob 58 causes the C-ring 42 to restore its clamping force on the arbor 26 to hold the visor in the position to which it has been moved. Mechanism 36 can be operated in a similar manner to raise or lower the outer visor 16.

It will be seen that we have accomplished the objects of our invention. We have provided a dual visor operating mechanism which is simple in construction for the results achieved thereby. Our dual visor operating mechanism is compact. It is less expensive to produce than are dual visor operating mechanisms of the prior art. Our dual visor operating mechanism permits of infinite adjustment of the inner and outer visors.

It will be understood that certain features and subcombinations are of utility and may be employed without reference to other features and subcombinations. This is contemplated by and is within the scope of our claims. It is further obvious that various changes may be made in detail within the scope of our claims without departing from the spirit of our invention. It is, therefore, to be understood that our invention is not to be limited to the specific details shown and described.

Having thus described our invention, what is claim is:

1. A helmet and visor assembly including in combination a helmet shell, a first arbor secured to said shell at one side thereof, a second arbor secured to said shell at the opposite side thereof, a visor mounted on said arbors for movement between operative and inoperative positions, means for clamping said visor to one of said arbors with a predetermined force, and manually operable means for releasing said clamping force and moving said visor between said positions, said clamping means comprising a C-ring on said one arbor and means coupling said C-ring to said visor for rotary movement therewith around said one arbor.

2. An assembly as in claim 1 in which said releasing means comprises an element mounted on said one arbor for movement relative thereto between a home position and a releasing position.

3. An assembly as in claim 2 in which said element is a ring having an elongated opening receiving said arbor, said releasing means comprising an actuator carried by said ring.

4. An assembly as in claim 1 in which said C-ring has a pair of legs, said coupling means comprising a pair of spaced pre-loading pins on said visor, said C-ring legs being disposed between said pre-loading pins.

5. An assembly as in claim 4 in which said visor comprises an arm having an opening for receiving said one arbor, said pre-loading pins being disposed on said arm, said arm having a longitudinal slot between said pins.

6. An assembly as in claim 1 in which said C-ring has a pair of legs with a space therebetween, said releasing means comprising an actuator disposed in said space.

7. An assembly as in claim 6 in which said actuator has a first dimension greater than and a second dimension less than the space between said legs, said releasing means comprising means for rotating said actuator to spread said legs to release said clamping force.

8. An assembly as in claim 7 in which said releasing means comprises an operating ring having an elongated opening therein, said operating ring being carried on said one arbor for movement relative thereto between an inactive position and a releasing position, said actuator being carried by said operating ring for rotation of the actuator upon movement of said operating ring from said inactive position to said releasing position.

9. An assembly as in claim 8 including means for limiting the movement of said operating ring relative to said one arbor.

10. An assembly as in claim 9 in which said movement limiting means comprises a second opening in said operating ring and a tang on said visor disposed in said second opening.

11. An assembly as in claim 8 including means for biasing said operating ring to a neutral position.

12. An assembly as in claim 1 including means for adjusting the operative position of said visor.

13. An assembly as in claim 12 in which said adjusting means comprises a stop element engaged by said manually operable means in the operative position of said visor and means for adjustably securing said element to said arbor.

14. An assembly as in claim 8 including means for adjusting the operative position of said visor.

15. An assembly as in claim 14 in which said adjusting means comprises a stop element adapted to be engaged by said manually operable means in the operative position of said visor and means for adjustably securing said element to said arbor.

16. A helmet and visor assembly including in combination a helmet shell, a first arbor secured to said shell at one side thereof, a second arbor secured to said shell at the opposite side thereof, a first visor mounted on said arbors for movement between operative and inoperative positions, a second visor mounted on said arbors for movement between operative and inoperative positions, means for clamping said first visor to one of said arbors with a predetermined force, first manually operable means for releasing the force of said first visor clamping means and for moving said first visor between said positions, means for clamping said second visor to the other one of said arbors with a predetermined force and second manually operable means for releasing the force of said second visor clamping means and for moving said second visor between said positions, each of said clamping means comprising a C-ring on the associated arbor and means coupling said C-ring to the corresponding visor for rotary movement therewith around said associated arbor.

17. An assembly as in claim 16 in which each of said releasing means comprises an element mounted on the associated arbor for movement relative thereto between a home position and a releasing position.

18. An assembly as in claim 17 in which said element is an operating ring having an elongated opening receiving the associated arbor, said releasing means comprising an actuator carried by said operating ring.

19. An assembly as in claim 16 in which each of said C-rings has a pair of legs, each of said coupling means comprising a pair of spaced pre-loading pins on the corresponding visor, the legs of each of said C-rings being disposed between the pre-loading pins of a respective corresponding one of said pairs.

20. An assembly as in claim 16 each of said C-rings has a pair of legs with a space therebetween, each of said releasing means comprising an actuator disposed in the space between the legs of the associated C-ring.

21. An assembly as in claim 20 in which each of said actuators has a first dimension greater than and a second dimension less than the space between the legs of the associated C-ring, each of said releasing means comprising means for rotating the corresponding actuator to spread the legs of the corresponding C-ring to release its clamping force.

22. An assembly as in claim 21 in which each of said releasing means comprises an operating ring having an elongated opening therein, each operating ring being carried by its associated arbor for movement between an inactive position and a releasing position, each actuator being carried by its associated operating ring for rotation of the actuator upon movement of said ring from said inactive position to said releasing position.

23. An assembly as in claim 22 in which each of said coupling means comprises a pair of spaced pre-loading pins carried by the corresponding visor, the legs of each of said C-rings being disposed between the pins of a respective corresponding one of said pairs.

* * * * *